US011040238B2

(12) United States Patent
Colburn

(10) Patent No.: US 11,040,238 B2
(45) Date of Patent: Jun. 22, 2021

(54) ELLIPTICAL EXERCISE APPARATUS

(71) Applicant: 17 Thrasio Seventeen, Inc., Medfield, MA (US)

(72) Inventor: Kevin Lawrence Colburn, Windsor, CO (US)

(73) Assignee: 17 Thrasio Seventeen, Inc., Medfield, MA (US)

( * ) Notice: Subject to any disclaimer, the term of this patent is extended or adjusted under 35 U.S.C. 154(b) by 63 days.

(21) Appl. No.: 16/213,914

(22) Filed: Dec. 7, 2018

(65) Prior Publication Data

US 2020/0129804 A1 Apr. 30, 2020

Related U.S. Application Data

(63) Continuation of application No. 29/668,109, filed on Oct. 26, 2018, now Pat. No. Des. 906,445.

(51) Int. Cl.

| | |
|---|---|
| ***A63B 22/06*** | (2006.01) |
| ***A63B 21/00*** | (2006.01) |
| ***A63B 21/22*** | (2006.01) |
| ***A63B 22/04*** | (2006.01) |
| ***A63B 22/00*** | (2006.01) |

(52) U.S. Cl.

CPC .... *A63B 22/0664* (2013.01); *A63B 21/00069* (2013.01); *A63B 21/225* (2013.01); *A63B 22/0046* (2013.01); *A63B 22/04* (2013.01); *A63B 22/0694* (2013.01); *A63B 2022/0676* (2013.01); *A63B 2208/0204* (2013.01)

(58) Field of Classification Search

CPC ..... A63B 21/00069; A63B 21/225; A63B 22/0046; A63B 22/04; A63B 22/0664; A63B 22/0694; A63B 2022/0676; A63B 2208/0204

See application file for complete search history.

(56) References Cited

U.S. PATENT DOCUMENTS

| | | | | |
|---|---|---|---|---|
| 5,529,554 | A * | 6/1996 | Eschenbach | A63B 22/0664 482/57 |
| D372,283 | S | 7/1996 | Chen | |
| 6,149,551 | A * | 11/2000 | Pyles | A63B 22/0664 482/51 |
| D446,266 | S | 8/2001 | Lin | |
| D452,285 | S | 12/2001 | Easley | |
| D461,211 | S | 8/2002 | Kuo | |
| D462,099 | S | 8/2002 | Chen | |
| D480,119 | S | 9/2003 | Chen | |
| D482,084 | S | 11/2003 | Yang | |
| D482,416 | S | 11/2003 | Yang | |
| D484,931 | S | 1/2004 | Tsai | |
| D514,635 | S | 2/2006 | Hsiao | |

(Continued)

OTHER PUBLICATIONS

Design U.S. Appl. No. 29/668,109, filed Oct. 26, 2018.

(Continued)

*Primary Examiner* — Joshua Lee

(74) *Attorney, Agent, or Firm* — Zeller IP Group, PLLC; Kyle M. Zeller

(57) ABSTRACT

A portable elliptical exercise apparatus where movement of the right pedal or left pedal defines an ellipse having an ellipse width and ellipse height, where the ellipse height can be incrementally varied according to the pedal surface location of a left foot or right foot on a corresponding left pedal or right pedal.

17 Claims, 12 Drawing Sheets

(56) References Cited

U.S. PATENT DOCUMENTS

| | | | | |
|---|---|---|---|---|
| D519,583 | S | 4/2006 | Chen | |
| D561,849 | S | 2/2008 | Piaget et al. | |
| D575,836 | S | 8/2008 | Hsiao | |
| D728,707 | S | 5/2015 | Colburn | |
| D744,050 | S | 11/2015 | Colburn | |
| 9,301,618 | B2 | 4/2016 | Leonhard | |
| D771,204 | S | 11/2016 | Ho et al. | |
| D773,567 | S | 12/2016 | Chuang | |
| D781,384 | S | 3/2017 | Ho et al. | |
| 9,713,739 | B2 * | 7/2017 | Dalmia | A63B 21/225 |
| D793,494 | S | 8/2017 | Mansfield et al. | |
| D794,142 | S | 8/2017 | Zhou | |
| D796,591 | S | 9/2017 | Ho et al. | |
| 9,757,611 | B1 * | 9/2017 | Colburn | A63B 22/0605 |
| D822,773 | S | 7/2018 | Khubani | |
| 10,052,516 | B1 | 8/2018 | Lin | |
| D827,732 | S | 9/2018 | Ho et al. | |
| 10,080,918 | B2 * | 9/2018 | Dalmia | A63B 22/06 |
| 10,220,246 | B2 * | 3/2019 | Lernihan | A63B 22/0015 |
| 2003/0036462 | A1 | 2/2003 | Ravikumar et al. | |
| 2003/0078140 | A1 | 4/2003 | Chang | |
| 2005/0009668 | A1 * | 1/2005 | Savettiere | A63B 22/0023 482/66 |
| 2007/0072742 | A1 * | 3/2007 | Chen | A63B 22/001 482/52 |
| 2007/0254782 | A1 | 11/2007 | Chen | |
| 2008/0058168 | A1 * | 3/2008 | Lin | A63B 22/0664 482/52 |
| 2010/0144495 | A1 | 6/2010 | Chen | |
| 2016/0107026 | A1 * | 4/2016 | Hsu | A63B 23/0476 482/80 |
| 2016/0317859 | A1 * | 11/2016 | Dalmia | A63B 21/225 |
| 2017/0216660 | A1 * | 8/2017 | Lernihan | A63B 22/0015 |
| 2017/0252603 | A1 | 9/2017 | Wu | |
| 2017/0319899 | A1 | 11/2017 | Jhang | |
| 2018/0015321 | A1 | 1/2018 | Ho et al. | |
| 2018/0126220 | A1 | 5/2018 | Palmer | |
| 2018/0207474 | A1 | 7/2018 | Chen | |
| 2019/0022456 | A1 * | 1/2019 | Dalmia | A63B 21/00069 |
| 2019/0299053 | A1 | 10/2019 | Friedman et al. | |

OTHER PUBLICATIONS

Amazon. Bionic Body Compact Under Desk Elliptical Stepper with Magnetic Resistance Tubes NS-1009. Website, https://www.amazon.com, originally downloaded Nov. 27, 2017, 1 page.

Amazon. Cubii Under Desk Elliptical, Bluetooth Enabled, Sync w/FitBit and HealthKit, Adjustable Resistance, Easy Assembly. Website, https://www.amazon.com, originally downloaded Nov. 27, 2017, I page.

Amazon. FitDesk Under Desk Elliptical. Website, https://www.amazon.com, originally downloaded Nov. 27, 2017, I page.

Amazon. jfit Under Desk & Stand Up Mini Elliptical/Stepper w/Adjustable Angle. Website, https://www.amazon.com, originally downloaded Nov. 27, 2017, 1 page.

Amazon. Mini Elliptical Under-Desk Exercise Machine. Website, https://www.amazon.com, originally downloaded Nov. 27, 2017, 1 page.

Amazon. Stamina InMotion Compact Strider. Website, https://www.amazon.com, originally downloaded Nov. 27, 2017, 1 page.

Amazon. Stamina InMotion Elliptical Trainer. Website, https://www.amazon.com, originally downloaded Nov. 27, 2017, 1 page.

* cited by examiner

ELLIPTICAL EXERCISE APPARATUS

I. FIELD OF THE INVENTION

A portable elliptical exercise apparatus where movement of the right pedal or left pedal defines an ellipse having an ellipse width and ellipse height, where the ellipse height can be incrementally varied according to the pedal surface location of a left foot or right foot on a corresponding left pedal or right pedal.

II. SUMMARY OF THE INVENTION

Accordingly, a broad object of the present invention is to provide a portable elliptical exercise apparatus including one or more of a chassis supported by a base, an axle rotationally journaled in said chassis, a pair of members each having a member first end coupled in co-rotating opposite extension to the axle, a left pedal support and a right pedal support each having a pedal support first end correspondingly rotating about a pivot coupled to a member second end, a left wheel and a right wheel correspondingly rotationally coupled to a pedal support second end, a left pedal and a right pedal correspondingly coupled to the left pedal support and the right pedal support, wherein rotation of the axle generates corresponding co-rotating elliptical movement of the left and right pedals and reciprocal opposed directional travel of the left wheel and the right wheel on the base, wherein the elliptical movement of the left pedal and the right pedal defines an ellipse, the ellipse having an ellipse width equal to a travel distance of the left wheel or the right wheel on the base occurring during one rotation of the axle, the ellipse having an ellipse height equal to a travel distance of a pedal surface height orthogonal to the base occurring during one rotation of the axle, the ellipse height varies between each pedal surface location between a pedal first end and a pedal second end, each of the left pedal and the right pedal having a pedal surface length disposed between a pedal first end and a pedal second end of about 15 inches to about 20 inches.

Another broad object of the present invention is to provide a method of using a portable elliptical exercise apparatus including one or more of positioning a left foot on a left pedal surface between a left pedal first end and a left pedal second end, positioning a right foot on a right pedal surface between a right pedal first end and a right pedal second end, each of the left pedal surface and the right pedal surface having a pedal surface length of about 15 inches to about 20 inches, the left pedal surface and the right pedal surface correspondingly coupled to a left pedal support and a right pedal support each having a pedal support first end pivotally coupled to one of a pair of members each having a member first end coupled in co-rotating opposite extension to an axle rotationally journaled in a chassis supported by a base and a pedal support second end correspondingly coupled to a left wheel and a right wheel, generating elliptical movement of the left and right pedal surfaces in reciprocal opposed directional travel of the left wheel and the right wheel on the base by corresponding forcible urging of the left foot or the right foot on the left pedal surface and the right pedal surface, and varying the height of the elliptical movement of the left foot or the right foot on the left pedal surface or the right pedal surface by correspondingly moving the left foot or the right foot along the left and right pedal surfaces between the pedal first end and the pedal second end.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
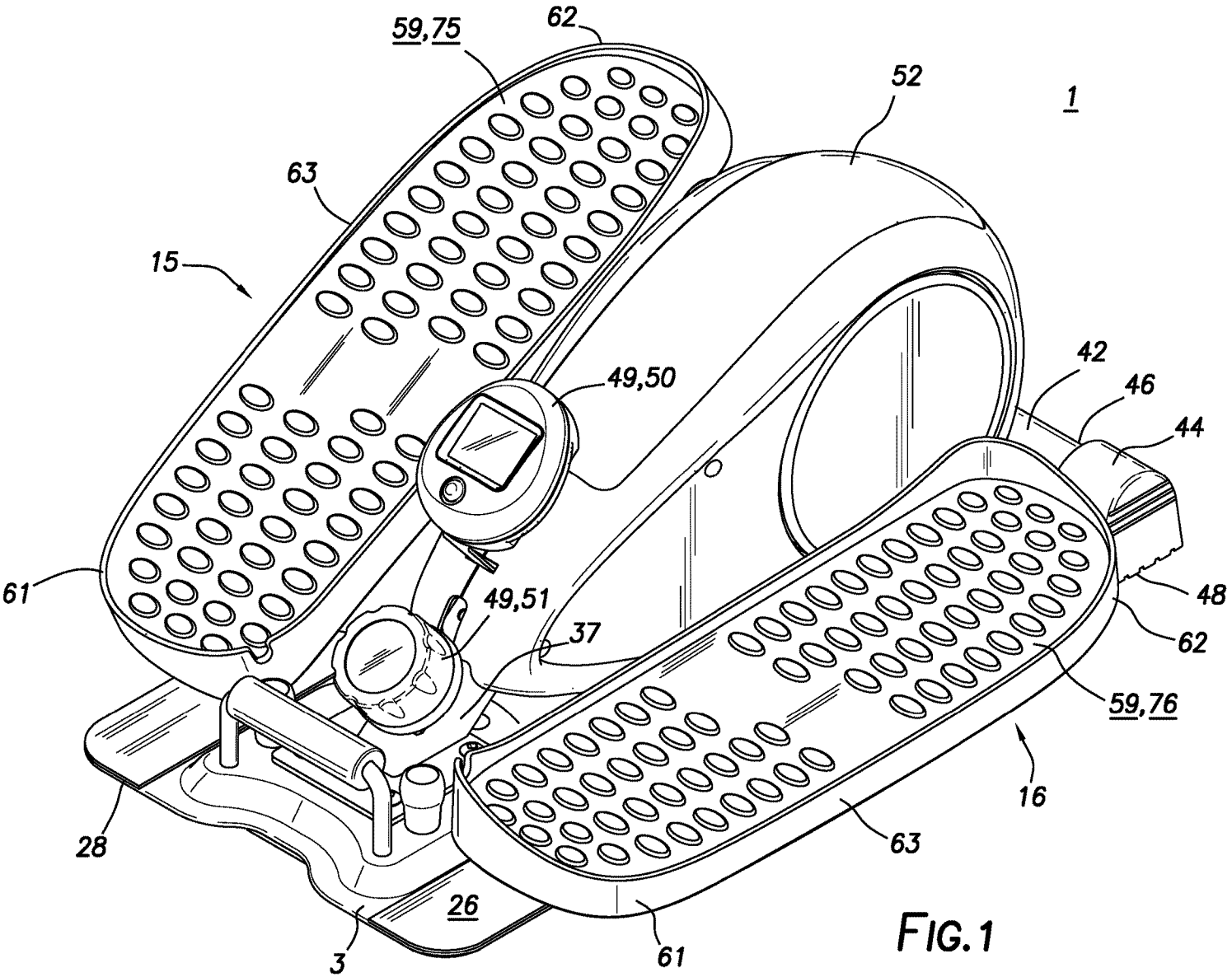
FIG. 1 is a top perspective view of a particular embodiment of an elliptical exercise apparatus.
Figure 2:
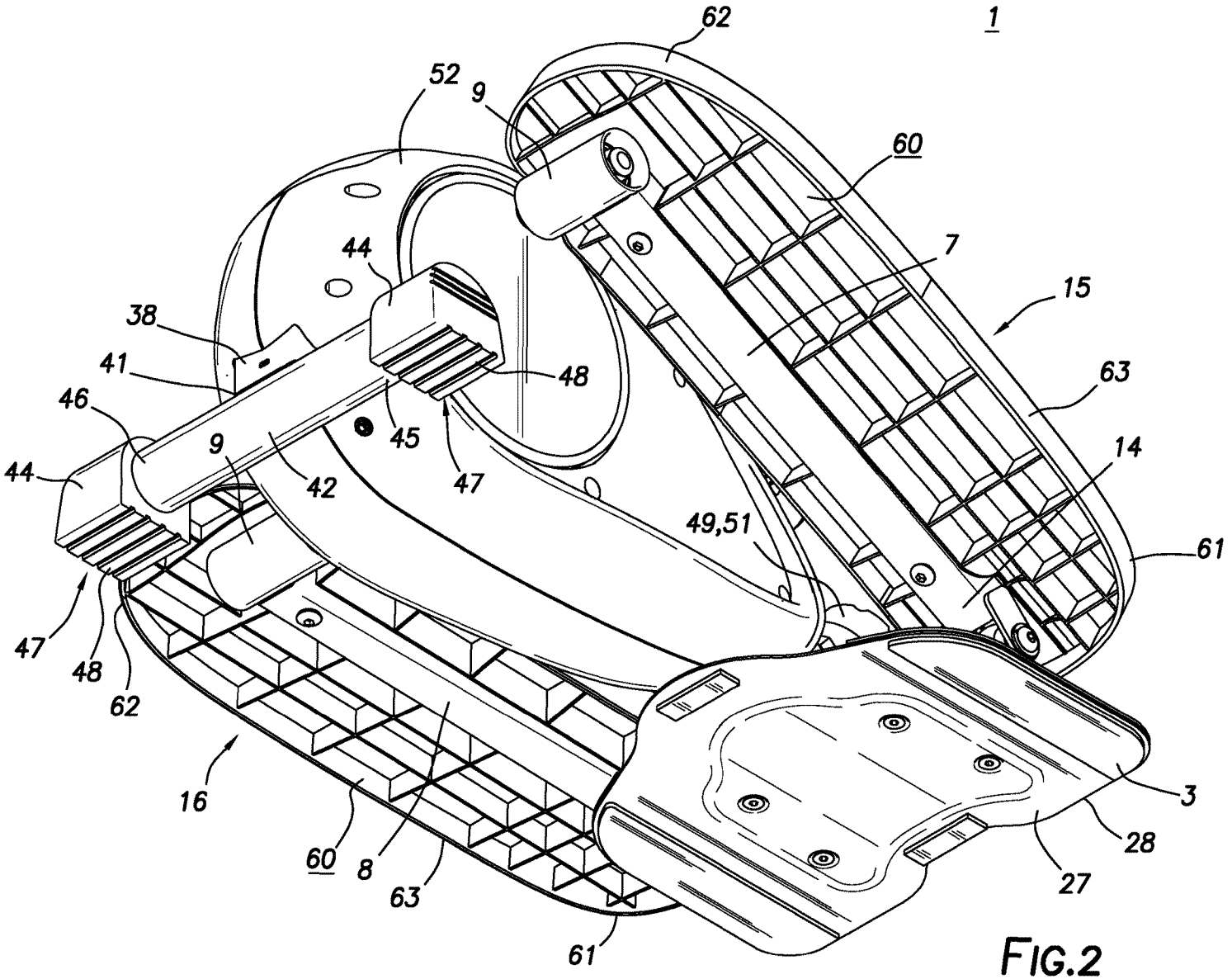
FIG. 2 is a bottom perspective view of a particular embodiment of an elliptical exercise apparatus.
Figure 3:
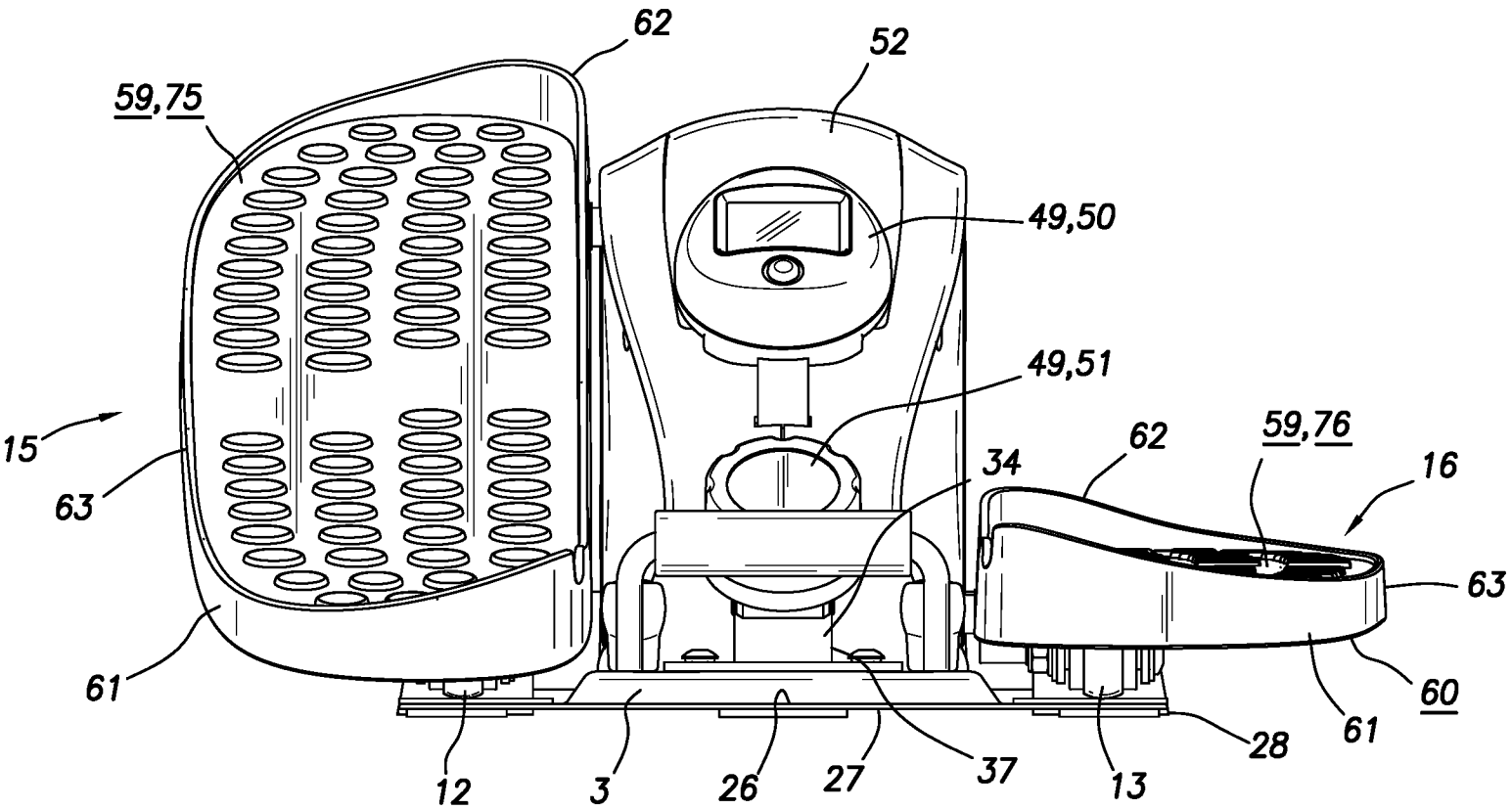
FIG. 3 is a rear elevation view of a particular embodiment of an elliptical exercise apparatus.
Figure 4:
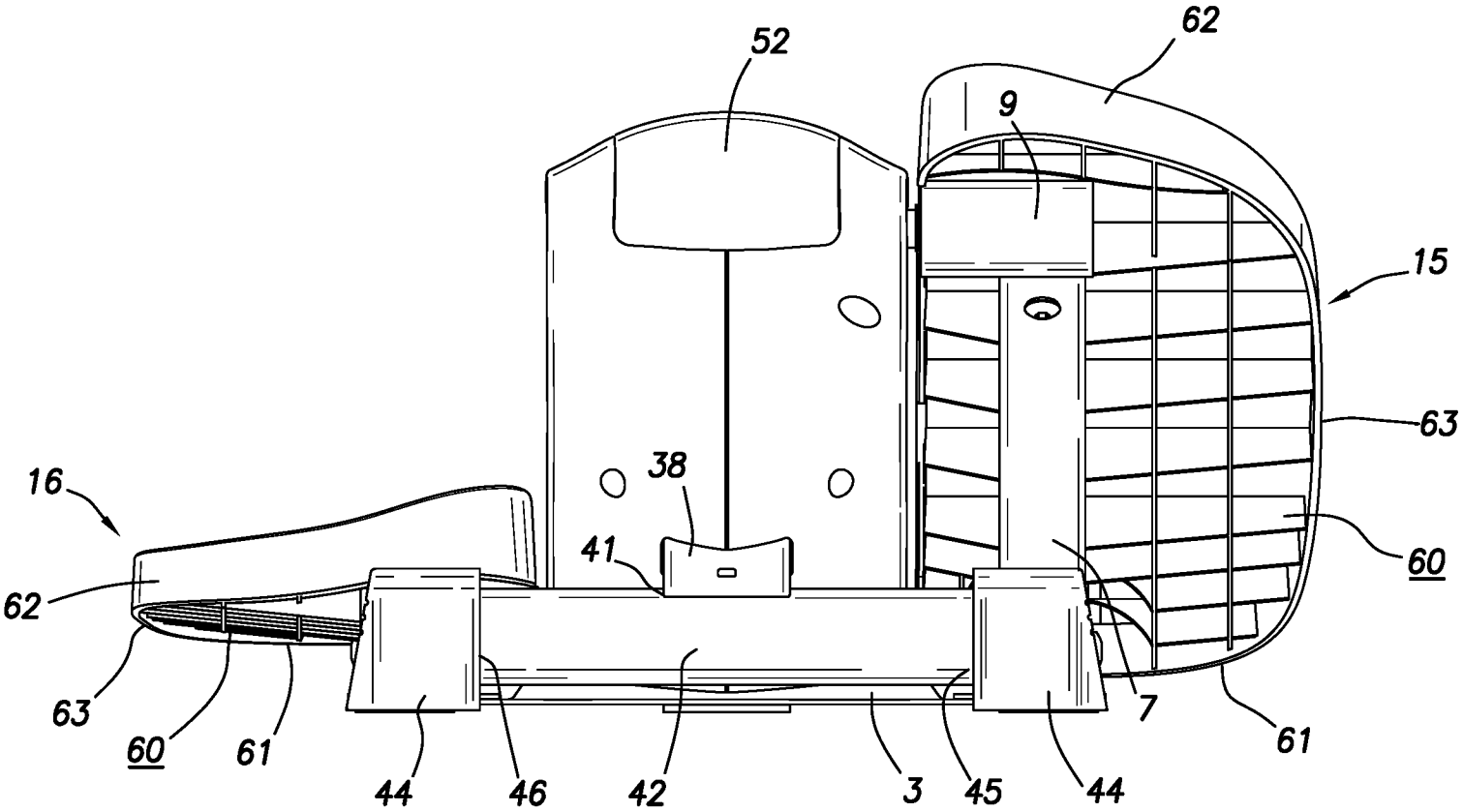
FIG. 4 is a front elevation view of a particular embodiment of an elliptical exercise apparatus.
Figure 5:
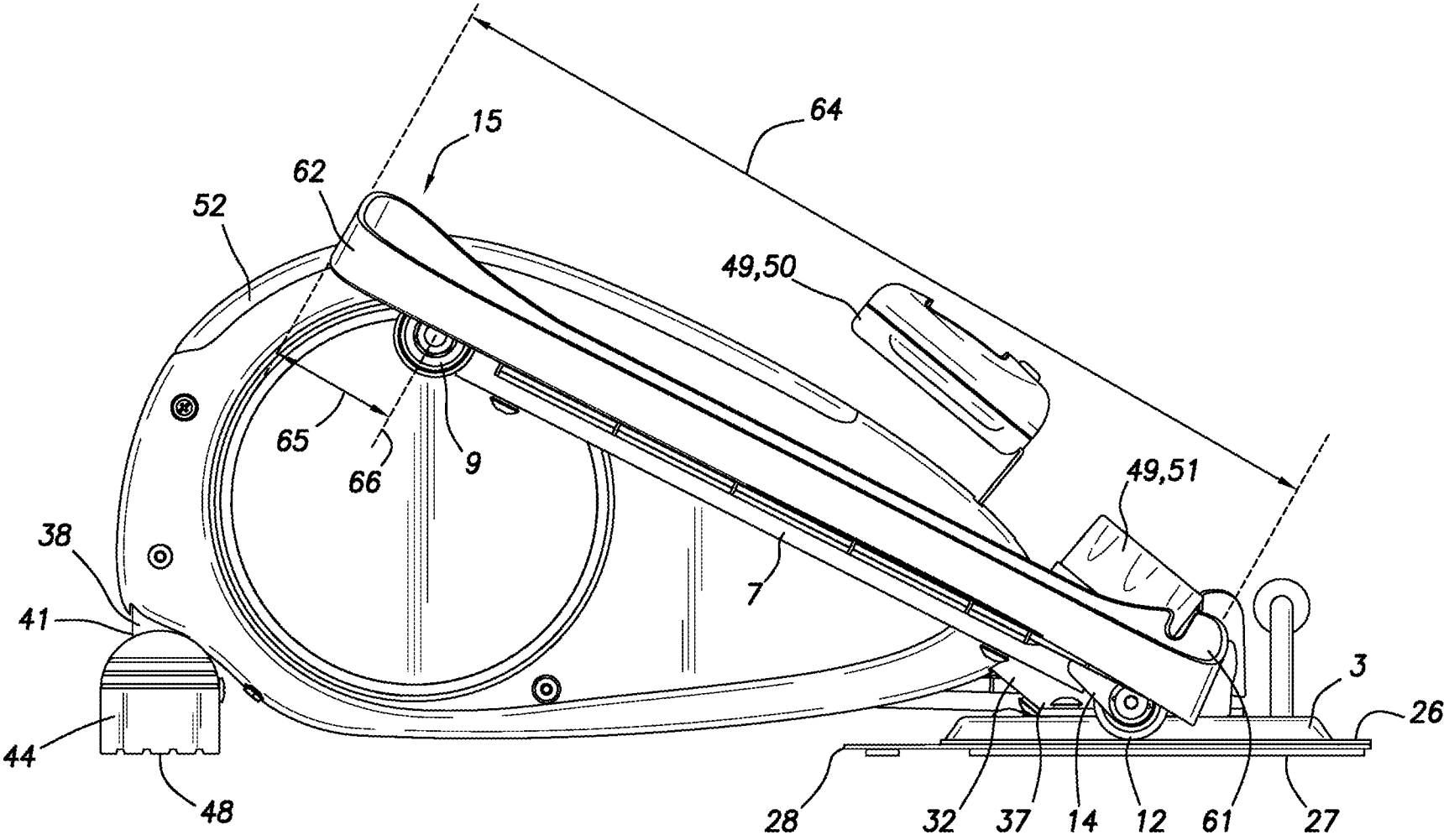
FIG. 5 is a first side elevation view of a particular embodiment of an elliptical exercise apparatus.
Figure 6:
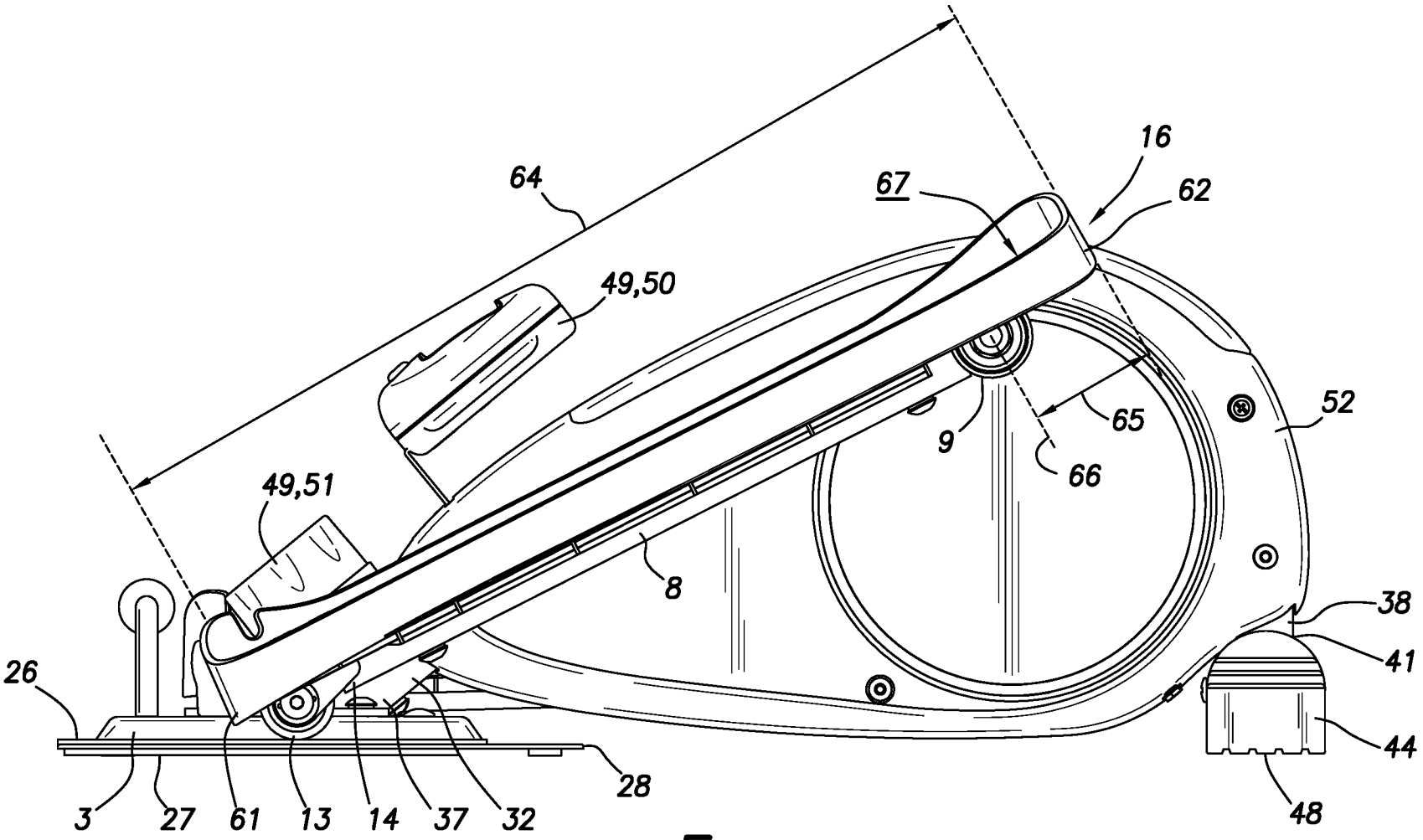
FIG. 6 is a second side elevation view of a particular embodiment of an elliptical exercise apparatus.
Figure 7:
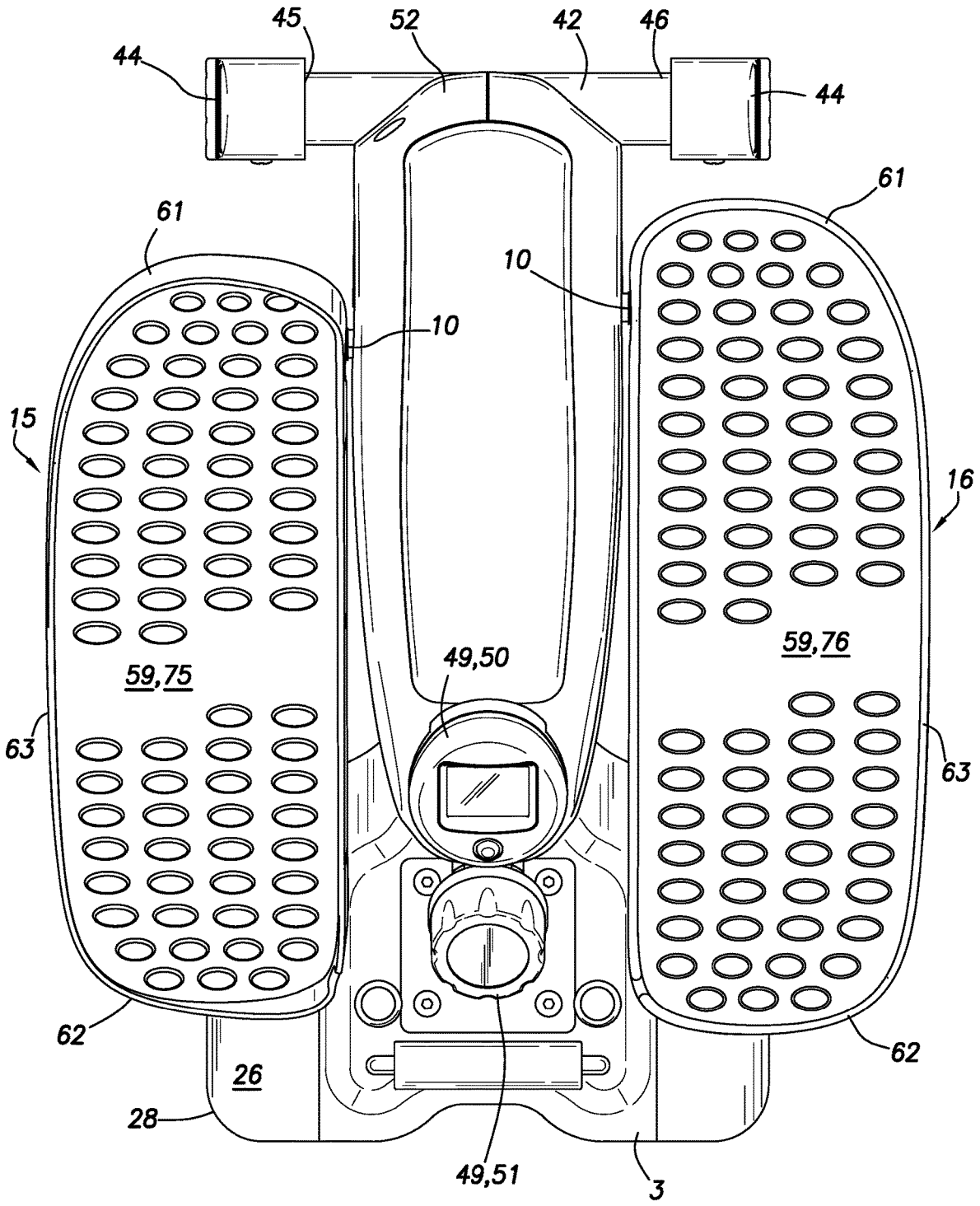
FIG. 7 is a top plan view of a particular embodiment of an elliptical exercise apparatus.

Generally, with reference to FIGS. 1 through 12, a portable elliptical exercise apparatus (1) including one or more of: a chassis (2) supported by a base (3), an axle (4) rotationally journaled in the chassis (2), a pair of members (5) each having a member first end (6) coupled in co-rotating opposite extension to the axle (4), a left pedal support (7) and a right pedal support (8) each having a pedal support first end (9) correspondingly rotating about a pivot (10) coupled to a member second end (11), a left wheel (12) and a right wheel (13) correspondingly rotationally coupled to a pedal support second end (14), a left pedal (15) and a right pedal (16) correspondingly coupled to said left pedal support (7) and said right pedal support (8), where movement of the right pedal (16) or the left pedal (15) defines an ellipse (17) having an ellipse width (18) equal to the travel distance (19) of the left wheel (12) or right wheel (13) and an ellipse height (20) equal to a travel distance (21) of a pedal surface height (22) orthogonal to the base (3) occurring during one rotation of the axle (4), where the ellipse height (20) varies according to the selected pedal surface location (23) on the left pedal (15) or the right pedal (16). Accordingly, by differential positioning of a left foot (24) or right foot (25) on a corresponding left pedal (15) or right pedal (16) the practiced ellipse height (20) can be incrementally varied by the user of the elliptical exercise apparatus (1).

Figure 9:
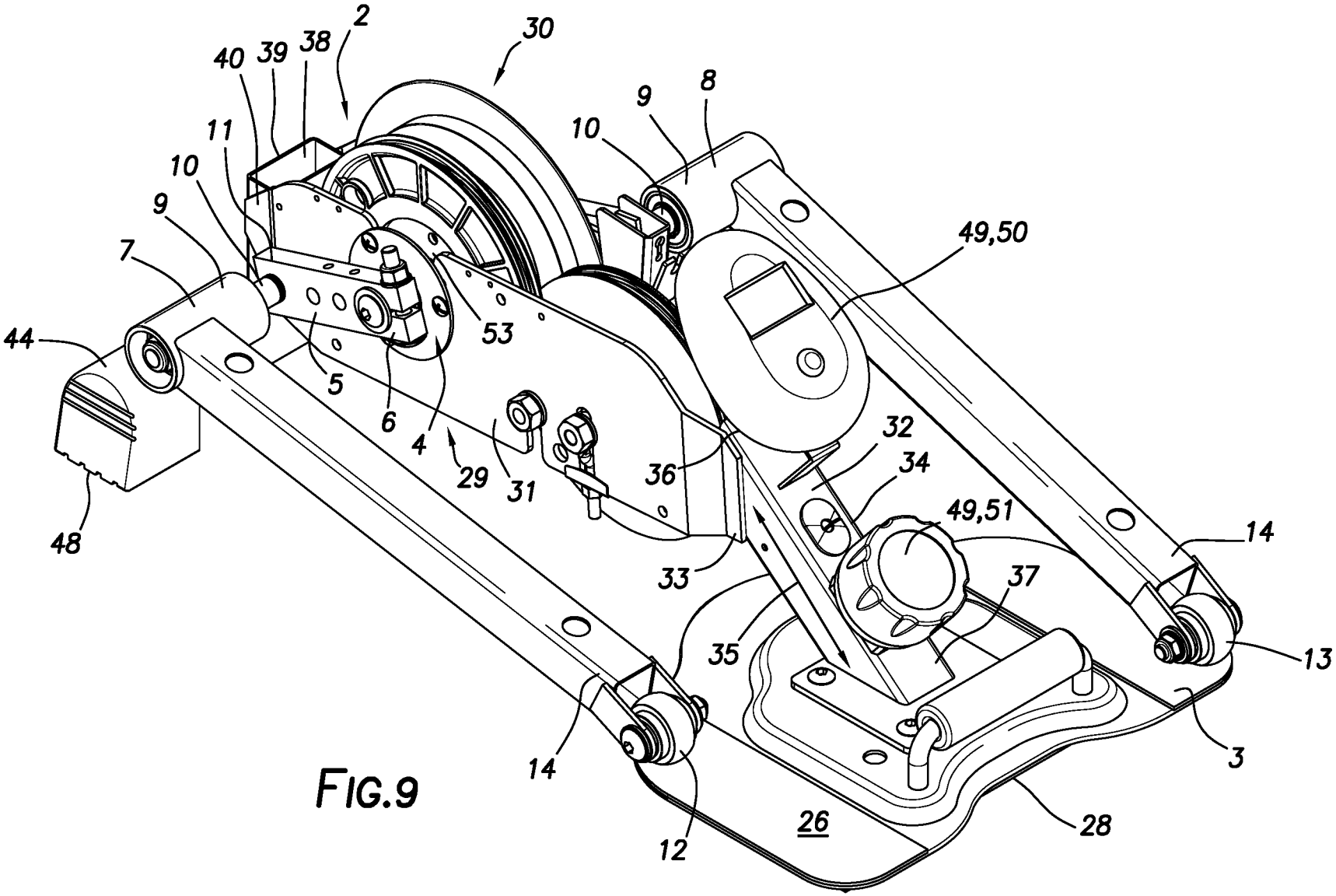
FIG. 9 is a top rear first side perspective view of a particular embodiment of the chassis and resistance assembly of an elliptical exercise apparatus.
Figure 10:
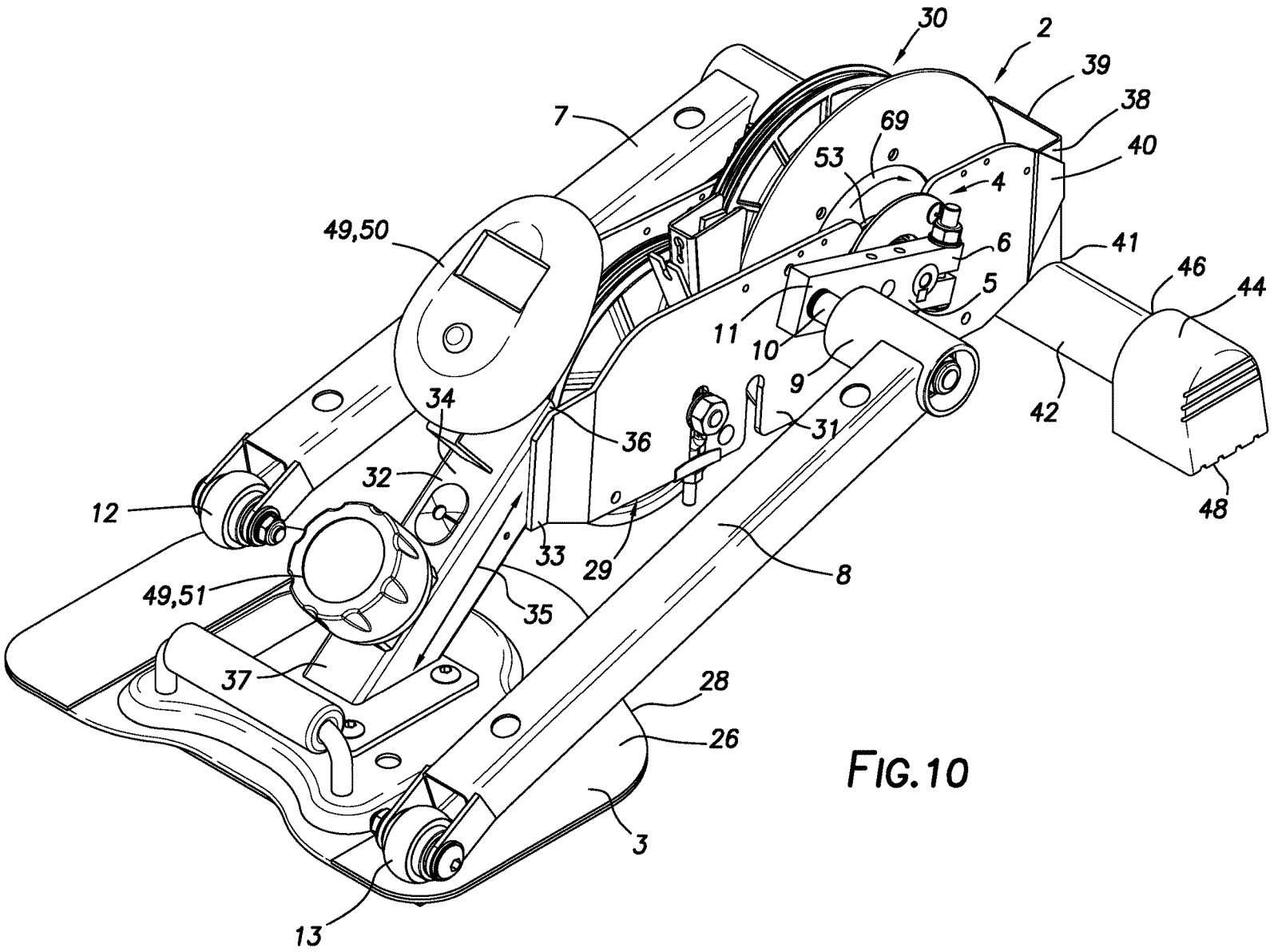
FIG. 10 is top rear second side perspective view of a particular embodiment of the chassis and resistance assembly of an elliptical exercise apparatus.
Figure 11:
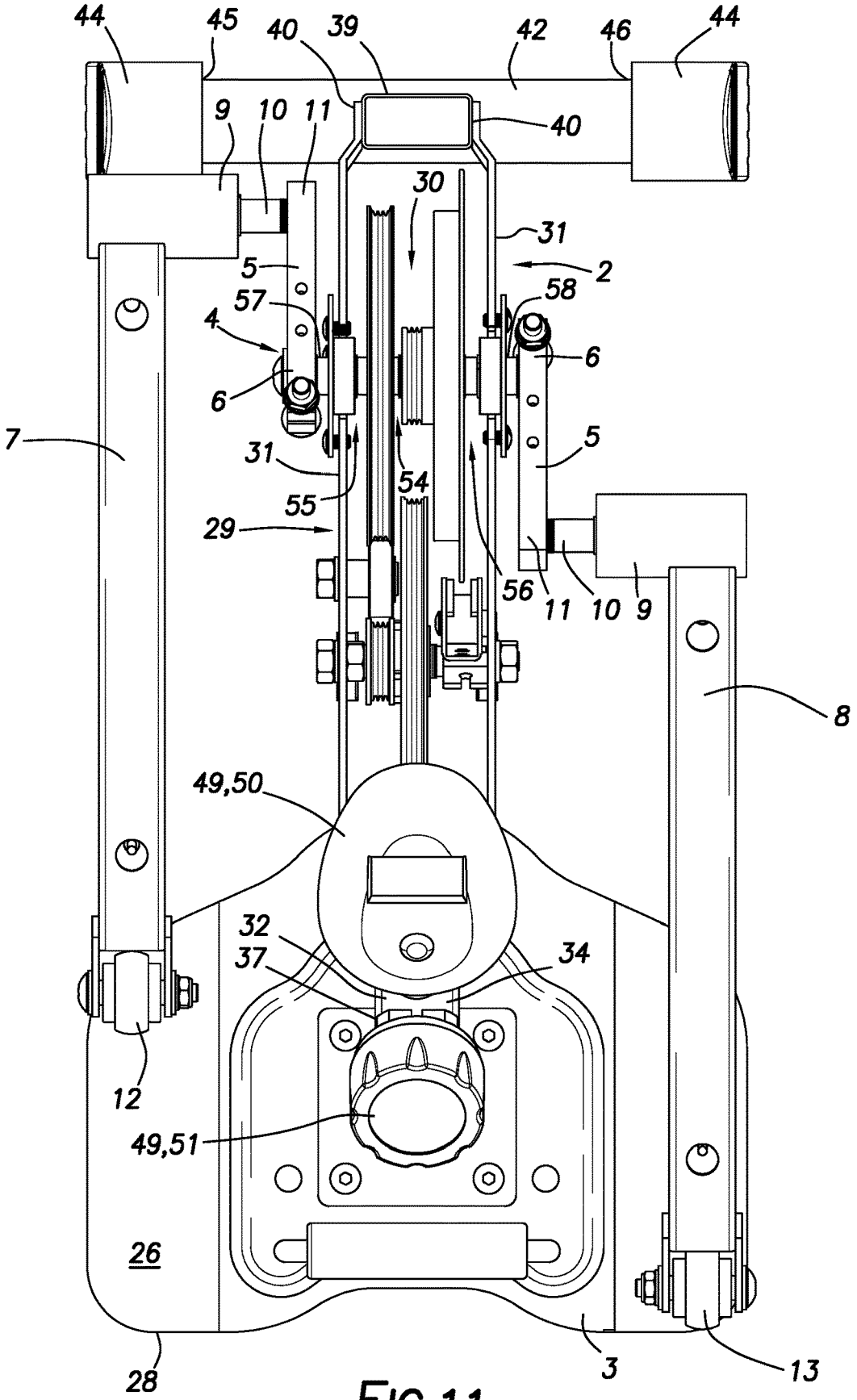
FIG. 11 is a top plan view of a particular embodiment of the chassis and resistance assembly of an elliptical exercise apparatus.

Now referring primarily to FIGS. 9 through 11, particular embodiments of the portable elliptical exercise apparatus (1) can include a chassis (2) supported by a base (3). The base (3) can include a top surface (26) and a bottom surface (27) extending to a base peripheral edge (28). The base peripheral edge (28) can define various configurations capable of supporting the portable elliptical exercise apparatus (1) in a stable upright position. The chassis (2) can include a frame (29) disposed about a resistance assembly (30).

Again, with reference to primarily FIGS. 9 through 11, the frame (29) can include pair of frame panels (31) disposed a distance apart allowing the resistance assembly (30) to be operatively disposed between the pair of frame panels (31). A rear frame support (32) can be coupled between the base (3) and the pair of frame panels first ends (33). The rear frame support (32) can comprise one central member (34) having a length (35) disposed between a rear frame support first end (36) coupled to the pair of frame panels first ends (33) and a rear frame support second end (37) coupled to the base (3).

Figure 8:
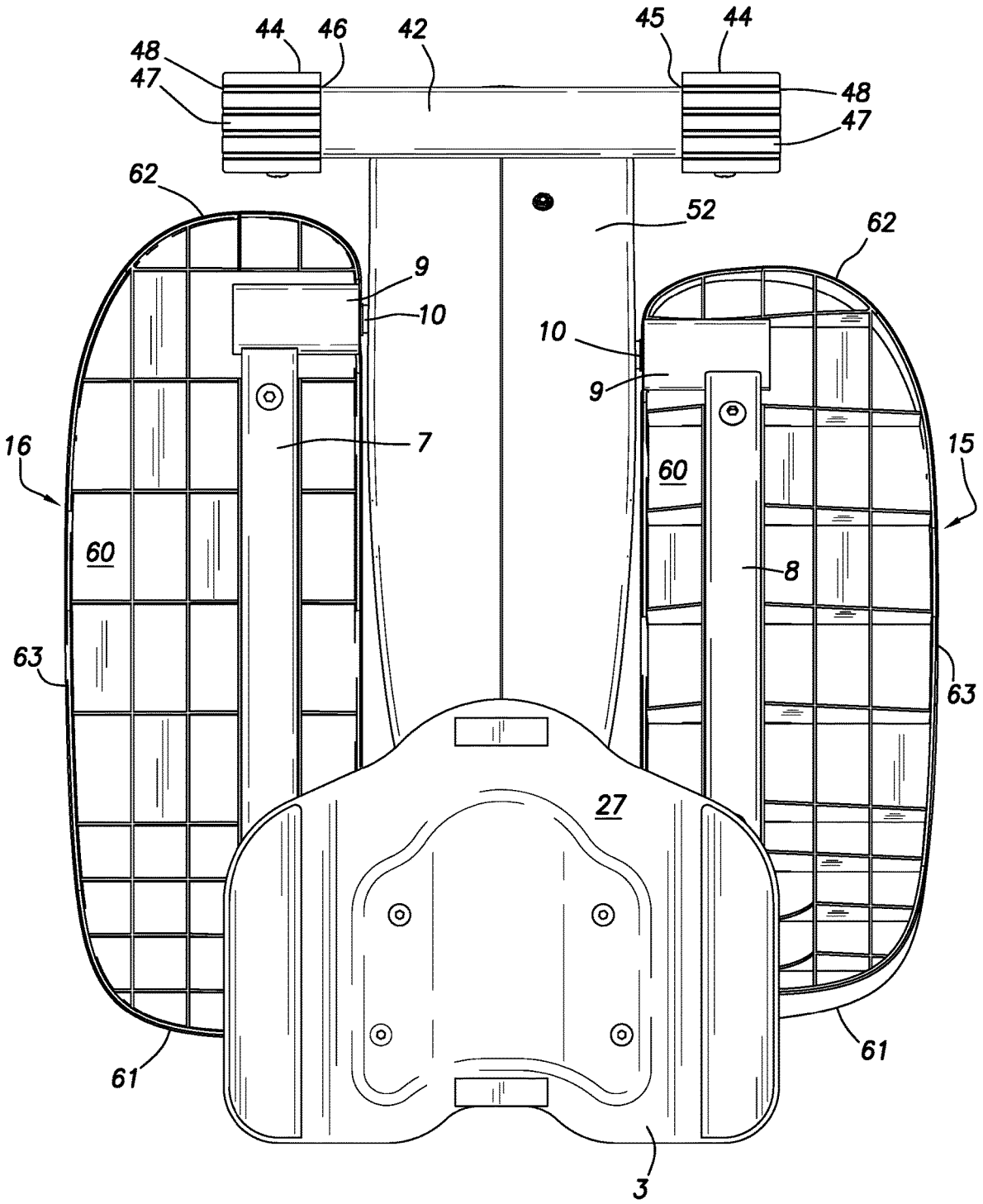
FIG. 8 is a bottom plan view of a particular embodiment of an elliptical exercise apparatus.

Again, with reference primarily to FIGS. 9 through 11, a front frame support (38) can be coupled by a front frame support first end (39) to the pair of frame panel second ends (40). The front frame support second end (41) can be medially coupled to a front frame support cross member (42) which can engage the support surface (43). In particular embodiments, as shown in the example of FIG. 8, a pair of end caps (44) can be coupled to the front frame support cross member first and second ends (45)(46). The pair of end caps (44) can each include a support surface engaging face (47) having patterned surface elements (48), although embodiments not including patterned surface elements (48) are contemplated. The patterned surface elements (48) can increase the amount of friction between the support surface (43) and the support surface engaging face (47).

Again, referring primarily to FIGS. 9 through 11, in particular embodiments, one or more control devices (49) can be coupled to the rear frame support (32). As nonlimiting examples, the one or more control devices (49) can be a timer (50) or a resistance knob (51) operatively coupled to the resistance assembly (30) to adjust resistance of the resistance assembly to movement of the left pedal (15) and the right pedal (16).

Now referring primarily to FIGS. 1 through 8, in further particular embodiments, the resistance assembly (30) and chassis (2) can be disposed within a chassis housing (52).

Now, referring primarily to FIGS. 9 through 11, particular embodiments of the portable elliptical exercise apparatus (1) can include an axle (4) rotationally journaled in the chassis (2). In particular embodiments, the pair of frame panels (31) can each have a corresponding one of an oppositely disposed pair of axle recesses (53) each adapted to receive the axle (4) therein. The axle (4) can have a medial portion (54) disposed in the axle recesses (53) with axle first and second end portions (55)(56) outwardly extending from each of the pair of axle recesses (53) to correspondingly terminate in opposite axle first and second ends (57)(58).

Again, referring primarily to FIGS. 9 through 11, particular embodiments of the portable elliptical exercise apparatus (1) can include a pair of members (5) each correspondingly coupled by a member first end (6) proximate the axle first end (57) and axle second end (58) in a co-rotating opposite extension to the axle (4). A left pedal support (7) and a right pedal support (8) can be correspondingly pivotally coupled by pedal support first ends (9) to correspondingly rotate about the pivot (10) or the respective member second end (11). A left wheel (12) and a right wheel (13) can further be rotationally coupled to the left pedal support second end (14) and the right pedal support second end (14), respectively. In further particular embodiments, the left wheel (12) and the right wheel (13) can, but need not necessarily, be rotationally engaged to the base (3). As an illustrative example, FIG. 9 shows the left wheel (12) and the right wheel (13) rotationally engaged to the top surface (26) of the base (3).

Now, referring primarily to FIGS. 1 through 8, particular embodiments of the portable elliptical exercise apparatus (1) can include a right pedal (16) and a left pedal (15) correspondingly coupled to the right pedal support (8) and the left pedal support (7). Each of the right pedal (16) and left pedal (15) can have a top surface (59) and a bottom surface (60) extending between a respective pedal first end (61) and pedal second end (62) to a pair of pedal edges (63). Each of the right and left pedals (15)(16) can have a pedal length (64) disposed between a respective pedal first end (61) and a pedal second end (62) of about 15 inches to about 20 inches. In particular embodiments, the pedal length (64) can be selected from the group consisting of: about 15.5 inches to about 16.5 inches, about 16 inches to about 17 inches, about 16.5 inches to about 17.5 inches, about 17 inches to about 18 inches, about 17.5 inches to about 18.5 inches, about 18 inches to about 19 inches, about 18.5 inches to about 19.5 inches, or combinations thereof. In particular embodiments, the pedal length (64) can be about 17.5 inches.

In particular embodiments, the top and bottom surfaces (59)(60) of the right pedal (16) and the left pedal (15) can extend a distance (65) beyond a pivot axis (66) of the respective pivot (10) about which the respective left pedal support (7) and right pedal support (8) rotate. The portion of the left pedal (15) and the right pedal (16) extending a distance (65) beyond the pivot axis (66) of the respective pivot (10) provides a pedal extension surface (67). The pedal extension surface (67) of each of the left and right pedal (15)(16) can dispose each of the respective left and right pedal first ends (61) a distance (65) beyond the pivot axis (66) of the respective pivot (10) about which the left pedal support (7) and the right pedal support (8) rotate. The pedal extension surface (67) can dispose either of the left or right pedal first ends (61) (or both) a distance beyond the pivot axis (66) of the respective pivot (10) of about 1 inch to about 4 inches. In particular embodiments, the pedal extension surface (67) can extend a distance (65) selected from the group consisting of: about 1.5 inches to about 2.5 inches, about 2 inches to about 3 inches, about 2.5 inches to about 3.5 inches, and about 3 inches to about 3.5 inches, or combinations thereof. In particular embodiments, the distance (65) can be about 2 inches.

Figure 12:
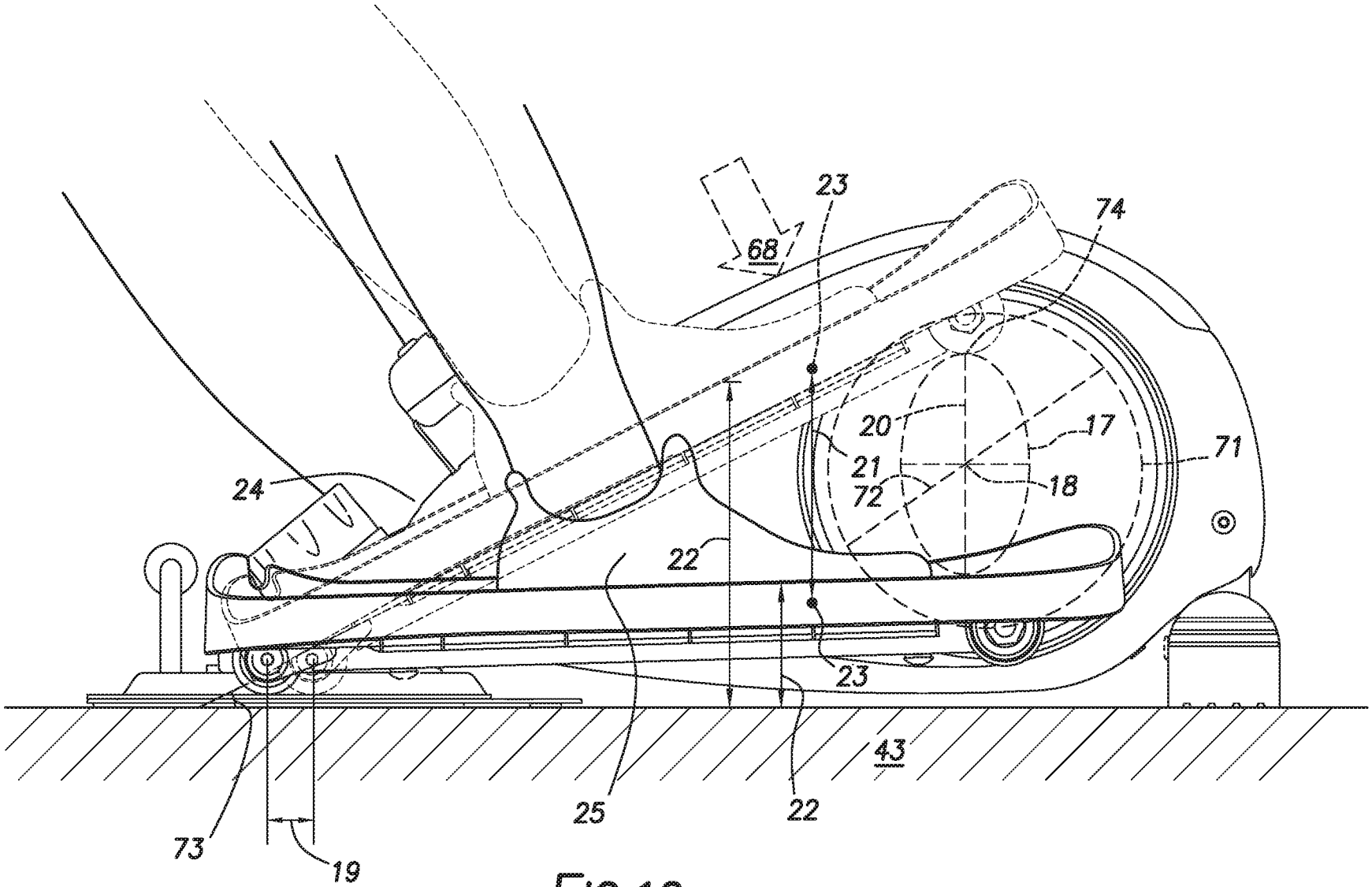
FIG. 12 illustrates a method of using a particular embodiment of an elliptical exercise apparatus.

Now referring primarily to FIG. 12, the axle (4) can rotate upon the application of a force (68) to either of the right pedal (16) or the left pedal (15). The rotation (69) of the axle (4) generates a corresponding co-rotating elliptical movement (70) of the left and right pedals (15)(16). Concurrently, the rotation (69) of the axle (4) generates a reciprocal opposed directional travel of the left wheel (12) and the right wheel (13) on the base (3). The elliptical movement (70) of the left pedal (15) and the right pedal (16) defines an ellipse (17). The ellipse (17) can have an ellipse width (18) equal to the travel distance (19) of the left wheel (12) or the right wheel (13) on the base (3) occurring during one rotation (69) of the axle (4). The ellipse (17) can have an ellipse height (20) equal to the travel distance (21) of a pedal surface height (22) orthogonal to the base (3) occurring during one rotation (69) of the axle (4). The ellipse height (20) can vary based upon the pedal surface location (23) of applied force (68) causing the axle (4) to rotate. The pedal surface location (23) can be any location on either the right pedal (16) or left pedal (15) between the respective pedal first end (61) and pedal second end (62).

Again, referring primarily to FIG. 12, the rotation (69) of the axle (4) upon the application of a force (68) to either of the right pedal (16) or the left pedal (15) can further cause co-rotation (69) of the pair of members (5). The pair of pivots (10) respectively coupled to each of the pair of members (5) can define a circle (71) having a diameter (72) of about 5 inches to about 7 inches. In particular embodiments, the defined circle (71) can have a diameter (72) selected from the group consisting of: about 5.25 inches to about 5.75 inches, about 5.5 to about 6.0 inches, about 5.75 inches to about 6.25 inches, about 6.0 inches to about 6.5 inches, or combinations thereof. In particular embodiments the defined circle (71) can have a diameter (72) of about 6.0 inches. The diameter (72) of the defined circle (71) can correlate to the ellipse width (18), which can equal the travel distance (19) of the left wheel (12) or the right wheel (13) on the base (3) occurring during one rotation (69) of the axle (4).

Now referring to FIG. 12, in particular embodiments having a top or bottom surface of a pedal (59)(60) extending a distance (65) beyond the pivot axis (66) of the respective pivot (10) about which the left pedal support (7) or said right pedal support (8) rotate, the elliptical movement (70) of the right or left pedal first end (61) can define an ellipse (17) having an ellipse height (20) greater than the diameter (72) of the circle (71) defined by the co-rotating pair of the member second ends (11). The ellipse height (20) can be about 6 inches to about 9 inches. In particular embodiments, the ellipse height (20) can be selected from the group consisting of: about 6.25 inches to about 6.75 inches, about 6.5 inches to about 7.0 inches, about 6.75 inches to about 7.25 inches, about 7.0 inches to about 7.5 inches, or combinations thereof. In particular embodiments, the ellipse height (20) can be about 6.0 inches.

Again referring to FIG. 12, the elliptical movement (70) of the top or bottom surface (59)(60) of the left or right pedal (15)(16) can define an angle (73) in relation to the support surface (43) upon which the portable elliptical exercise apparatus (1) engages of less than about 30 degrees. In particular embodiments, top or bottom surface (59)(60) of the left or right pedal (15)(16) disposed at the top (74) of the ellipse (17) can define an angle (73) in relation to the support surface (43) of about 25 degrees to about 30 degrees. In further particular embodiments the angle (73) can be selected from the group consisting of: about 25.5 degrees to about 26.5 degrees, about 26 degrees to about 27 degrees, about 26.5 degrees to about 27.5 degrees, about 27 degrees to about 28 degrees, about 27.5 degrees to about 28.5 degrees, about 28 degrees to about 29 degrees, about 28.5 degrees to about 29.5 degrees, and combinations thereof.

Particular methods of using the portable elliptical exercise apparatus (1) can include positioning a left foot (24) on a left pedal top surface (75), positioning a right foot (25) on a right pedal top surface (76), generating elliptical movement (70) of the left and right pedal top surfaces (75)(76) by forcibly urging the left foot (24) or right foot (25) on the corresponding left or right pedal top surface (75)(76), and varying the height (77) of the elliptical movement (70) of the left foot (24) or right foot (25) by correspondingly moving the left foot (24) or right foot (25) along the left and right pedal top surfaces (75)(76) between the pedal first and second ends (61)(62).

As can be easily understood from the foregoing, the basic concepts of the present invention may be embodied in a variety of ways. The invention involves numerous and varied embodiments of portable elliptical exercise apparatus (1) and methods for making and using such portable elliptical exercise apparatus (1) including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pedal" should be understood to encompass disclosure of the act of "pedaling"—whether explicitly discussed or not—and, conversely, were there effectively disclosure of the act of "pedaling", such a disclosure should be understood to encompass disclosure of a "pedal" or even a "means for pedaling." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the portable elliptical exercise apparatus (1) herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A portable elliptical exercise apparatus, comprising:

a chassis supported by a base, the chassis comprising a frame having a pair of frame panels, each of the frame panels comprising:

a corresponding one of an oppositely disposed pair of axle recesses;

a rear end coupled to the base via a rear frame support; and a front end coupled to a front frame support having a cross member;

an axle rotationally journaled in said chassis, the axle comprising:

a medial portion disposed in the pair of axle recesses; and first and second end portions outwardly extending from each of the pair of axle recesses;

a pair of members each having a member first end coupled in co-rotating opposite extension to said axle;

a left pedal support and a right pedal support each having a pedal support first end correspondingly rotating about a pivot coupled to a member second end;

a left wheel and a right wheel correspondingly rotationally coupled to a pedal support second end; and a left pedal and a right pedal correspondingly coupled to said left pedal support and said right pedal support, the left and right pedals each having a pedal surface extending a length of about 15 inches to about 20 inches between a pedal first end and a pedal second end, wherein rotation of said axle generates corresponding co-rotating elliptical movement of said left and right pedals and reciprocal opposed directional travel of said left wheel and said right wheel on said base, and wherein said elliptical movement of said left pedal and said right pedal defines an ellipse having an ellipse width and an ellipse height, said ellipse width equal to a travel distance of said left wheel or said right wheel on said base occurring during one rotation of said axle, and said ellipse height equal to a travel distance of a pedal surface height orthogonal to said base occurring during one rotation of said axle, such that said ellipse height varies at each pedal surface location between the pedal first end and the pedal second end.

2. The apparatus of claim 1, wherein co-rotating opposite extension of either one of said pair of members at said pivot defines a circle having a diameter of about 5 inches to about 7 inches.

3. The apparatus of claim 2, wherein the diameter of the circle is selected from the group consisting of: about 5.25 inches to about 5.75 inches, about 5.5 to about 6.00 inches, about 5.75 inches to about 6.25 inches, and about 6.00 inches to about 6.5 inches.

4. The apparatus of claim 3, wherein the diameter of the circle is about 6 inches.

5. The apparatus of claim 1, wherein the pedal surface of said left pedal or said right pedal extends a distance beyond a pivot axis of said pivot about which said left pedal support or said right pedal support rotates.

6. The apparatus of claim 1, wherein said pedal surface of said left or right pedal includes a pedal extension surface disposing said first pedal end of the left or right pedal a distance of about 1 inch to about 4 inches beyond said pivot axis of said pivot about which said left pedal support or said right pedal support rotates.

7. The apparatus of claim 6, wherein said distance beyond said pivot axis is selected from the group consisting of: about 1.5 inches to about 2.5 inches, about 2 inches to about 3 inches, about 2.5 inches to about 3.5 inches, and about 3 inches to about 3.5 inches.

8. The apparatus of claim 7, wherein said distance beyond said pivot axis is about 2 inches.

9. The apparatus of claim 6, wherein the ellipse height is further defined by the elliptical movement of said pedal extension surface.

10. The apparatus of claim 9, the ellipse height is from of about 6 inches to about 9 inches.

11. The apparatus of claim 10, wherein said ellipse height is selected from the group consisting of: about 6.25 inches to about 6.75 inches, about 6.5 to about 7.00 inches, about 6.75 inches to about 7.25 inches, and about 7.00 inches to about 7.5 inches.

12. The apparatus of claim 11, wherein said ellipse height is about 6 inches.

13. The apparatus of claim 1, wherein said pedal surface length of the left and right pedals is selected from the group consisting of: about 15.5 inches to about 16.5 inches, about 16 inches to about 17 inches, about 16.5 inches to about 17.5 inches, about 17 inches to about 18 inches, about 17.5 inches to about 18.5 inches, about 18 inches to about 19 inches, and about 18.5 inches to about 19.5 inches.

14. The apparatus of claim 13, wherein said pedal surface length of the left and right pedals is about 17.5 inches.

15. The apparatus of claim 1, wherein:

the base and the cross member of the front frame support each engage a support surface;

said elliptical movement of said left pedal or said right pedal defines an angle in relation to said support surface of about 30 degrees or less.

16. The apparatus of claim 15, wherein said is from about 25 degrees to about 30 degrees.

17. The apparatus of claim 16, wherein is selected from the group consisting of: about 25.5 degrees to about 26.5 degrees, about 26 degrees to about 27 degrees, about 26.5 degrees to about 27.5 degrees, about 27 degrees to about 28 degrees, about 27.5 to about 28.5 degrees, about 28 degrees to about 29 degrees, and about 28.5 degrees to about 29.5 degrees.

* * * * *